US006602120B2

(12) United States Patent
Bavelloni

(10) Patent No.: US 6,602,120 B2
(45) Date of Patent: Aug. 5, 2003

(54) EDGE GRINDING UNIT FOR EDGE WORKING MACHINES

(75) Inventor: Franco Bavelloni, San Fermo Dalla Battaglia (IT)

(73) Assignee: Z. Bavelloni S.p.A., Bregnano (IT)

( * ) Notice: Subject to any disclaimer, the term of this patent is extended or adjusted under 35 U.S.C. 154(b) by 55 days.

(21) Appl. No.: 09/946,336

(22) Filed: Sep. 6, 2001

(65) Prior Publication Data

US 2002/0034927 A1 Mar. 21, 2002

(30) Foreign Application Priority Data

Sep. 20, 2000 (IT) ..... MI2000A2049

(51) Int. Cl.[7] ..... B24B 9/00

(52) U.S. Cl. ..... 451/236; 451/44; 451/211; 451/139; 451/174; 451/280; 451/310; 144/103; 83/490; 409/183

(58) Field of Search ..... 451/44, 211, 236, 451/139, 174, 280, 310; 83/490, 491; 144/103; 409/183, 64, 78, 201

(56) References Cited

U.S. PATENT DOCUMENTS

| | | | | | |
|---|---|---|---|---|---|
| 1,997,386 | A | | 4/1935 | Louviaux | |
| 2,021,198 | A | * | 11/1935 | Owen | 451/242 |
| 2,561,929 | A | * | 7/1951 | Klages | 451/146 |
| 2,583,758 | A | * | 1/1952 | Webber | 451/128 |
| 3,928,945 | A | | 12/1975 | Devillers | |
| 4,266,373 | A | * | 5/1981 | Bornefeld et al. | 451/236 |
| 4,528,780 | A | * | 7/1985 | Halberschmidt et al. | 451/14 |
| 4,667,443 | A | * | 5/1987 | Sakurai et al. | 451/236 |
| 5,289,661 | A | * | 3/1994 | Jones et al. | 451/44 |
| 5,479,971 | A | * | 1/1996 | Marshall | 144/4.1 |
| 5,613,894 | A | * | 3/1997 | Delle Vedove | 451/1 |
| 5,980,364 | A | * | 11/1999 | Bentley | 451/51 |

FOREIGN PATENT DOCUMENTS

| | | |
|---|---|---|
| FR | 2 429 647 | 1/1980 |

* cited by examiner

*Primary Examiner*—George Nguyen
(74) *Attorney, Agent, or Firm*—Guido Modiano; Albert Josif; Daniel O'Byrne

(57) ABSTRACT

An edge grinding unit for machines for working the edges of plates in general and of glass sheets in particular comprising at least at one rim of a plate being worked, a grinding wheel which is accommodated in a carousel element provided with a rotatable cage formed by a plurality of circumferentially distributed rollers. The edge grinding unit further comprising an arm for supporting the grinding wheel which provides, for the grinding wheel, a first oscillation axis and a second oscillation axis which are spaced one another and are substantially perpendicular to the advancement plane of the plate.

12 Claims, 3 Drawing Sheets

EDGE GRINDING UNIT FOR EDGE WORKING MACHINES

BACKGROUND OF THE INVENTION

The present invention relates to an edge grinding unit for machines for working the edges of plates in general and of glass sheets in particular.

It is known that edge grinding units are currently applied to machines for working the edges of plates in general and of glass sheets in particular; in practice, such units are designed to produce a slight bevel at the edge of the plate.

This operation, which is absolutely necessary in the case of glass sheets which must subsequently be subjected to tempering, is designed to bevel the edge and is performed by means of a grinding wheel which can rotate inside a carousel element constituted by a cage formed by a plurality of rollers which rest against the edge of the plate, so that the grinding wheel forms the bevel in the intended manner.

In the solutions of the prior art, the edge grinding unit is generally constituted by an oscillating arm which supports a grinding wheel and is pushed by way of elastic means against the front edge of the incoming plate in order to bevel the front edge.

Then, as it continues its translational motion, the plate in practice moves the arm so that the rollers engage the longitudinal edge, without contact between the grinding wheel and the plate, until once the grinding wheel has reached the rear edge, such grinding wheel rises to work the rear edge. The movement of the plate, albeit very slow, in many cases does not allow to work the rear edge correctly, since the movement of the arm and therefore of the grinding wheel occurs in the opposite direction with respect to the advancement of the glass sheet.

In order to try to obviate this drawback, the edge grinding unit has been fitted on two linear guides so that when it makes contact with the glass sheet in order to work the front edge, the grinding wheel moves outwards and then follows said sheet, by means of the second slider, in order to work the rear edge thereof.

In the solution of the known art there are considerable masses in motion, since the unit also supports the motor that actuates the grinding wheel; moreover, such unit must follow the plate for a certain extent and perform the return stroke.

Accordingly, such edge grinding units force a reduction in the speed of translational motion of the plate, because the grinding wheel must follow, for a certain extent, the plate during the working of the rear edge thereof.

Moreover, it is necessary to keep a certain distance between the contiguous plates, because after a rear edge has been worked, the arm with the corresponding grinding wheel must be returned to the initial condition by means of the translational return motion of the entire movable unit, so that the grinding wheel returns to the initial conditions in order to engage the front edge of the next plate.

In this context, low operating speeds and considerable moving masses are involved and therefore collisions can occur between the grinding wheel and the plate being worked, with the consequent possibility of damaging said plate.

SUMMARY OF THE INVENTION

The aim of the invention is to eliminate the above mentioned drawbacks by providing an edge grinding unit for machines for working the edges of plates in general and of glass sheets in particular which allows to considerably increase operating speeds thereby increasing the speed of the translational motion of the plates being worked.

Within this aim, an object of the invention is to provide an edge grinding unit which allows to reduce the distance between two contiguous plates being worked, thus reducing idle times.

Another object of the present invention is to provide an edge grinding unit which allows to reduce the moving masses, thus allowing to apply lower pressures and reducing the impact that inevitably occurs when the plate contacts the grinding wheel; accordingly, the speed with which the glass sheet makes contact with the grinding wheel can be much higher, with the advantage of higher productivity of the machine.

Another object of the present invention is to provide an edge grinding unit which thanks to its particular constructive characteristics, is capable of giving the greatest assurances of reliability and safety in use.

This aim and these and other objects which will become better apparent hereinafter are achieved by an edge grinding unit for machines for working the edges of plates in general and of glass sheets in particular, which comprises, at least at one rim of a sheet being worked, a grinding wheel accommodated in a carousel element provided with a rotatable cage formed by a plurality of circumferentially distributed rollers, characterized in that it comprises means for supporting said grinding wheel which form, for said grinding wheel, a first oscillation pivot and a second oscillation pivot which are mutually spaced and are substantially perpendicular to the advancement plane of said plate.

BRIEF DESCRIPTION OF THE DRAWINGS

Further characteristics and advantages will become better apparent from the description of a preferred but not exclusive embodiment of an edge grinding unit for machines for working the edges of plates in general and of glass sheets in particular, illustrated only by way of non-limitative example in the accompanying drawings, wherein.

DESCRIPTION OF THE PREFERRED EMBODIMENTS

Figure 1:
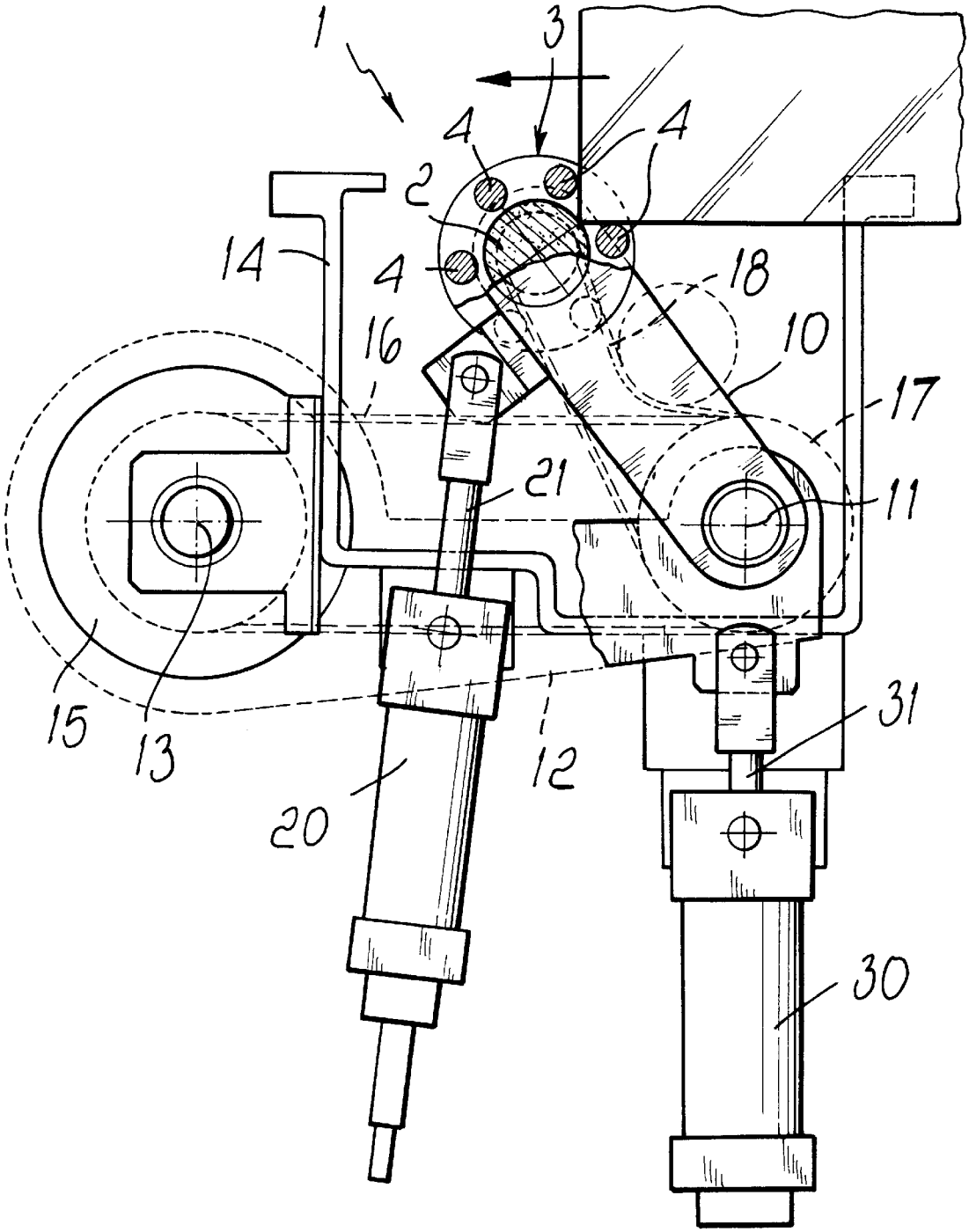
FIG. 1 is a view of the edge grinding unit when the grinding wheel engages the front edge.
Figure 2:
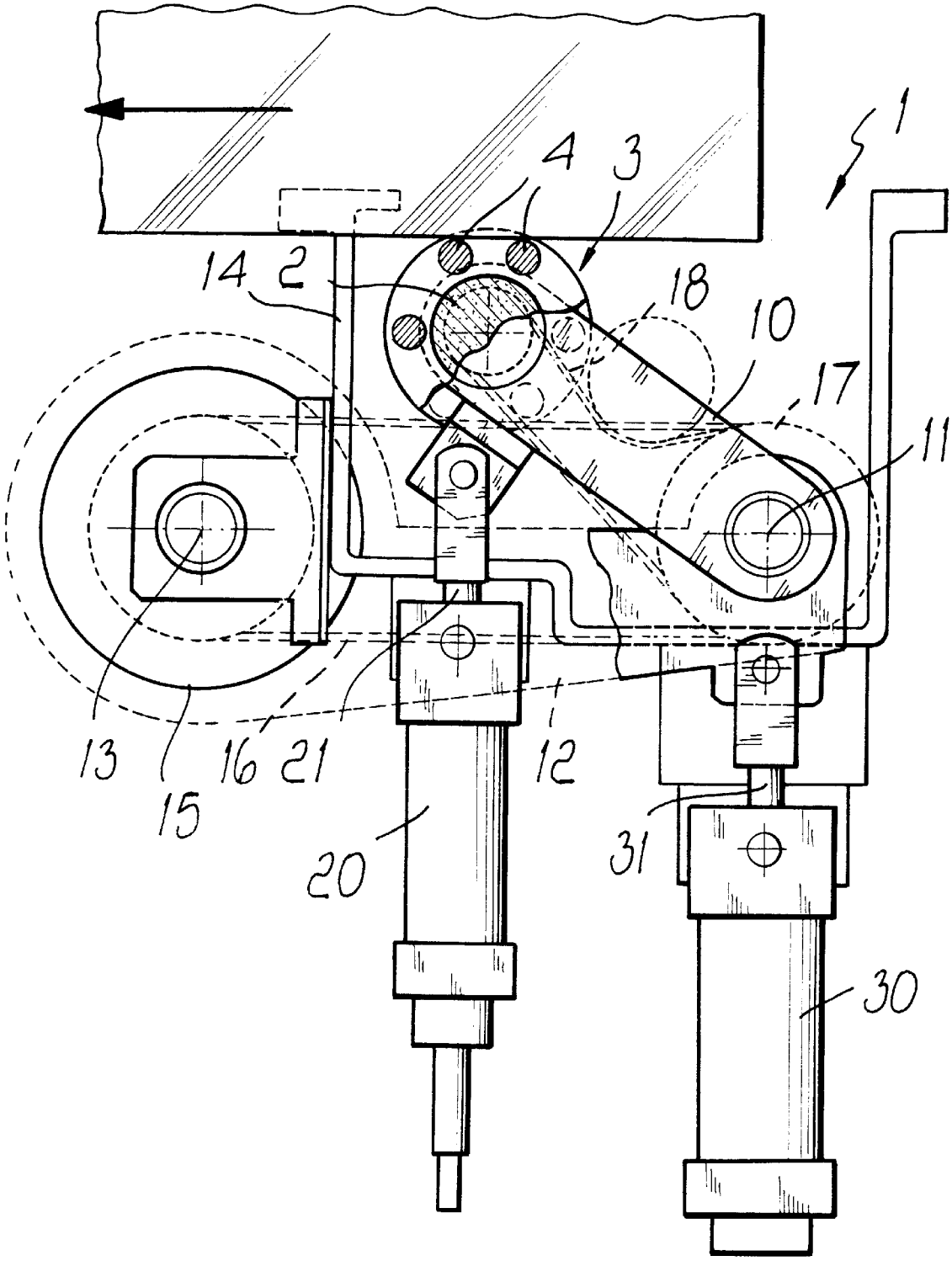
FIG. 2 is a view of the edge grinding unit during the step for engaging the carousel element with the longitudinal edge of the plate.
Figure 3:
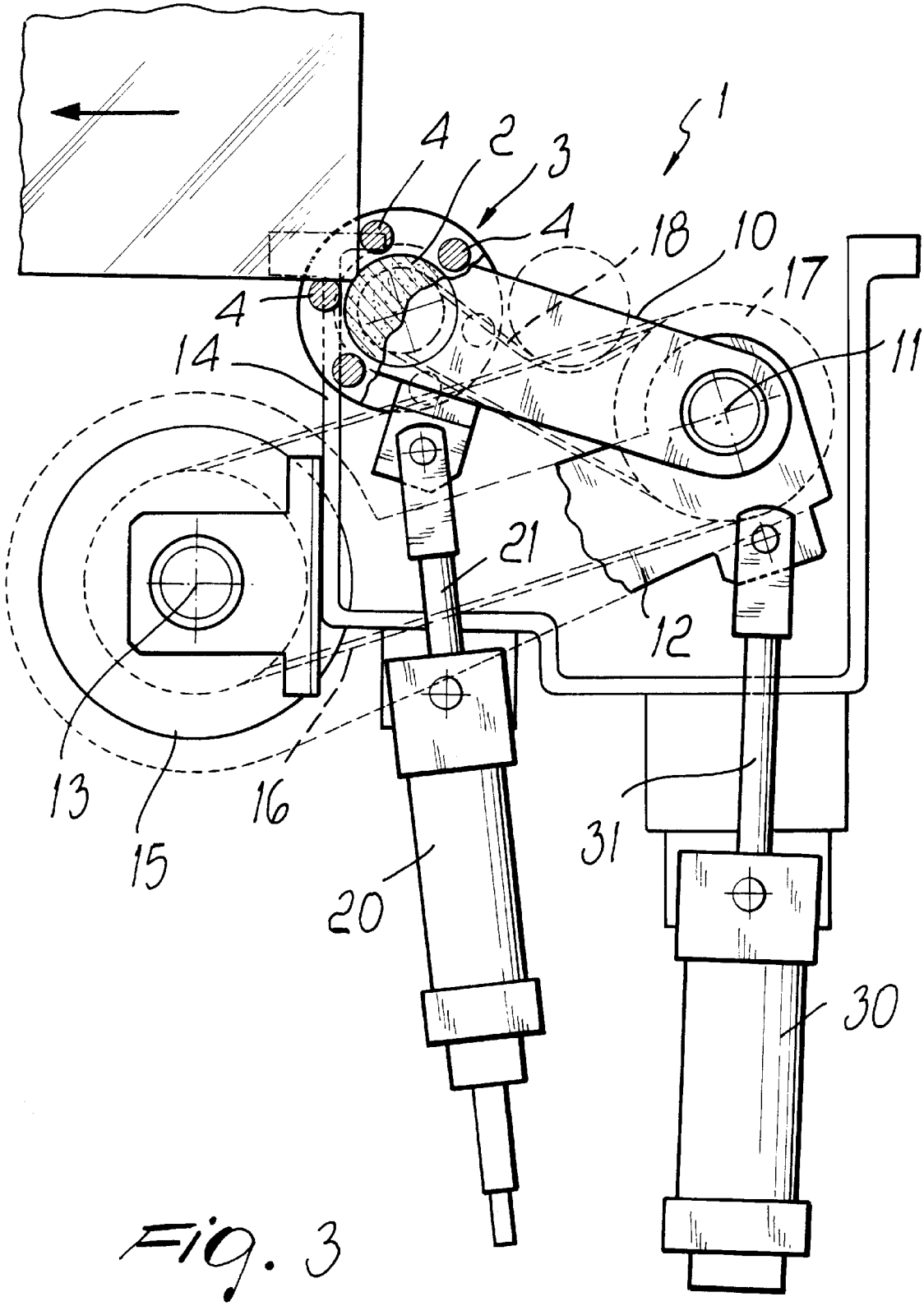
FIG. 3 is a view of the step in which the grinding wheel engages the rear edge of the plate.

With reference to the figures, the edge grinding unit for machines for working the edges of plates in general and of glass sheets in particular, generally designated by the reference numeral 1, is generally connected to the end of machines for working the edges of plates and, in the case of machines that work two opposite edges simultaneously, two edge grinding units are usually provided, one for each side, whereas in the case of machines that work only one edge of a plate, which is arranged for example vertically, there is a single edge grinding unit arranged vertically at the end of the working of said edge.

The edge grinding unit 1 comprises a grinding wheel 2 which, in a per se known manner, is mounted inside a carousel element 3 which, as is known, is constituted by a cage formed by a plurality of rollers 4 being arranged circumferentially and being designed to engage the rim of the sheet and the edge being worked, so as to precisely determine the type of bevel to be made.

The particularity of the invention consists in that for said grinding wheel 2 supporting means are provided which are constituted by a working arm 10 which supports said grinding wheel 2 at one end and at the other end thereof is articulated by means of a first pivot 11 to a coupling arm 12 which is in turn articulated, by means of a second pivot 13, to the fixed structure of the machine, generally designated by the reference numeral 14.

At said second pivot 13 there is the grinding wheel driving motor, designated by the reference numeral 15, which drives a first belt 16 which winds around a pulley 17 which can rotate about the first pivot 11 and is coaxial to a pulley for driving a second belt 18 that turns the grinding wheel.

The particularity of the invention therefore consists in that the grinding wheel 2 can oscillate about two separate pivots, i.e., a first oscillation pivot or axis 11 and a second oscillation pivot or axis 13.

Actuation means are also provided, constituted by a first cylinder 20 which is articulated to the fixed structure 14 and whose actuation stem 21 is articulated to the working end of the working arm 10; there is also a second cylinder 30, whose stem 31 is articulated to the coupling arm 12 at the articulation end of the working arm 10.

This arrangement makes it possible to produce the oscillation of the working arm 10 by means of the first cylinder 20 in a direction which in practice makes the grinding wheel work against the front edge of the plate, as shown in FIG. 1.

Once the front edge has been worked, the plate in practice causes the working arm to rotate in the opposite direction, so that the carousel element slides along the longitudinal rim of the plate until, when the rear edge reaches the grinding wheel, the second cylinder 30 is actuated and, by producing an oscillation of the coupling arm 12 in a direction which is the opposite of the working oscillation of the first arm 10, allows the grinding wheel to follow the rear edge in order to perform the required work.

With the described arrangement, in which the working movement of the grinding wheel is performed by way of two oscillations in the opposite directions about two distinct pivots, the grinding wheel can return into position immediately after working the rear edge, thus eliminating the idle times between one plate and the next that occur in the solutions of the known art, in which the grinding wheel was subjected to an oscillation in order to make contact with the edge and to a translational motion in order to follow the rear edge to work it.

The two oscillations which can be performed with actuators constituted by cylinders allows first of all to reduce return times significantly; moreover, by connecting the grinding wheel driving motor at the second pivot 13, which is in a fixed position, the moving masses are smaller, thus reducing the impacts between the grinding wheel and the plate and accordingly reducing the possibility of breakage.

From the above description it is evident that the invention achieves the intended aim and objects, and in particular the fact is stressed that an edge grinding unit is provided which, by using two separate oscillations about different pivots and with opposite rotations, allows to increase significantly the operating speeds, since the grinding wheel, after completing the working of the rear edge, returns very rapidly to the initial position for working the front edge of the next plate.

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements.

The disclosures in Italian Patent Application No. MI2000A002049 from which this application claims priority are incorporated herein by reference.

What is claimed is:

1. An edge grinding unit for edge working machines adapted to work edges of plates, comprising: a carousel element provided with a rotatable cage formed by a plurality of circumferentially distributed rollers at least at one grinding wheel arrangeable at a rim of a plate to be worked and accommodated in said carousel element; supporting means for supporting said grinding wheel; said supporting means providing first and second oscillation axes for said grinding wheel, which are spaced one from the other and are substantially perpendicular to an advancement plane of said plate.

2. The edge grinding unit of claim 1, wherein said supporting means comprise: a working arm which supports said grinding wheel at a first end thereof, a coupling arm and a first pivot, said working arm being connected at a second end thereof to said coupling arm, at said first oscillation axis, through said first pivot.

3. The edge grinding unit of claim 2, further comprising a second coupling arm being connected to a fixed structure of the machine for working the edges of the plate by way of a second pivot at said second oscillation axis.

4. The edge grinding unit of claim 3, further comprising a motor arranged at said second pivot, for driving said grinding wheel; pulleys mounted at said first pivot connecting said coupling arm and said working arm; and a first and a second belt connected to said motor and, respectively, winding around said pulleys to actuate said grinding wheel.

5. The edge grinding unit of claim 4, further comprising actuation means for actuating in oscillation said arms, said actuation means being constituted, respectively, by a first cylinder, which is articulated to the fixed structure of the machine and is connected to said working arm, and by a second cylinder, which is articulated to said fixed structure and is connected to said coupling arm.

6. The edge grinding unit of claim 5, wherein said working arm is actuatable so as to move said grinding wheel to work against a front edge of the plate to be worked by rotation of the working arm in a first direction, and said coupling arm is actuatable to place said grinding wheel at a rear edge of the plate to be worked by rotation of the coupling arm in an opposite direction.

7. An edge grinding unit for edge working machines adapted to work edges of plates, comprising: a carousel element provided with a rotatable cage formed by a plurality of circumferentially distributed rollers at least at one grinding wheel arrangeable at a rim of a plate to be worked and accommodated in said carousel element; a supporting element for supporting said grinding wheel; said supporting element providing first and second oscillation axes for said grinding wheel, which are spaced one from the other and are substantially perpendicular to an advancement plane of said plate.

8. The edge grinding unit of claim 7, wherein said supporting element comprises; a working arm which supports said grinding wheel at a first end thereof, a coupling arm and a first pivot, said working arm being connected at a second end thereof to said coupling arm, at said first oscillation axis, through said first pivot.

9. The edge grinding unit of claim 8, further comprising a second coupling arm being connected to a fixed structure of the machine for working the edges of the plate by way of a second pivot at said second oscillation axis.

10. The edge grinding unit of claim 9, further comprising a motor arranged at said second pivot, for driving said grinding wheel; pulleys mounted at said first pivot connecting said coupling arm and said working arm; and a first and a second belt connected to said motor and, respectively, winding around said pulleys to actuate said grinding wheel.

11. The edge grinding unit of claim 10, further comprising an actuation element for actuating in oscillation said arms, said actuation element comprising, respectively, a first cylinder, which is articulated to the fixed structure of the machine and is connected to said working arm, and a second cylinder, which is articulated to said fixed structure and is connected to said coupling arm.

12. The edge grinding unit of claim 11, wherein said working arm is actuatable so as to move said grinding wheel to work against a front edge of the plate to be worked by rotation of the working arm in a first direction, and said coupling arm is actuatable to place said grinding wheel at a rear edge of the plate to be worked by rotation of the coupling arm in an opposite direction.

* * * * *